US005681158A

United States Patent [19]

Knapp

[11] Patent Number: 5,681,158

[45] Date of Patent: Oct. 28, 1997

[54] SINGLE-STAGE PROCESS FOR DISPOSAL OF CHEMICALLY BOUND NITROGEN IN INDUSTRIAL WASTE STREAMS

[75] Inventor: Gerhard F. Knapp, San Clemente, Calif.

[73] Assignee: GFK Consulting Limited, San Clemente, Calif.

[21] Appl. No.: 405,266

[22] Filed: Mar. 14, 1995

[51] Int. Cl.[6] ..... F23D 14/00

[52] U.S. Cl. ..... 431/5; 431/4; 431/8

[58] Field of Search ..... 431/115, 5, 8, 431/10, 4

[56] References Cited

U.S. PATENT DOCUMENTS

| | | | |
|---|---|---|---|
| 2,753,925 | 7/1956 | Campell et al. | 431/5 |
| 3,195,608 | 7/1965 | Voorheis et al. | 431/5 |
| 3,207,201 | 9/1965 | Zink et al. | 431/5 |
| 3,237,677 | 3/1966 | Von Wiesenthal et al. | 431/5 |
| 3,311,456 | 3/1967 | Denny et al. . | |
| 3,794,459 | 2/1974 | Meenan | 431/5 |
| 3,873,671 | 3/1975 | Reed et al. | 423/235 |
| 3,900,554 | 8/1975 | Lyon | 423/235 |
| 4,033,725 | 7/1977 | Reed et al. | 431/5 |
| 4,044,099 | 8/1977 | Griffin . | |
| 4,441,880 | 4/1984 | Pownall et al. . | |
| 4,519,993 | 5/1985 | McGill et al. | 423/235 |
| 4,629,413 | 12/1986 | Michelson et al. | 431/9 |
| 5,118,481 | 6/1992 | Lyon | 423/235 |
| 5,527,984 | 6/1996 | Stultz et al. | 431/5 |

FOREIGN PATENT DOCUMENTS

| | | | |
|---|---|---|---|
| 3545524 | 7/1987 | Germany | 431/5 |

OTHER PUBLICATIONS

Bruce Johnson & Kevin McZuigg, John Zink Company; The Effects of Operating (no date) Conditions on Emissions from a Fume Incinerator; pp. 31–35.

Ronald D. Bell; Radian Corporation; Hybrid Low $NO_x$ Process for Destruction of Bound Nitrogen Compounds; pp. 325–328 (no date).

Peter B. Nutcher & David A. Lewandowski; Integrated Incinerator Design for $NO_x$ Control; pp. 329–333 (no date).

JoAnn S. Lighty, David L. Gordon, David W. Pershing, Warren D. Owens, Vic. A. Cundy and Christopher N. Leger; The Effect of Fuel Nitrogen On $NO_x$ Emissions from a Rotary–Kiln Incinerator; pp. 5B–45 – 5B–64.

Peter B. Nutcher and David A. Lewandowski; Control of Nitrogen Oxides in Waste Incineration; pp. 13–28 (no date).

L.C. Shen, C.T. Lin, R.C. Chang and J.H. Pohl; An Investigation of $NO_x$ Control with SNCR in 2.5MW Test Furnace; pp. 491–493.

R.K. Srivastava, J.V. Ryan, W.P. Linak, R.E. Hall, J.A. McSorley and J.A. Mulholland; Application of Low $NO_x$ Precombustor Technology to the Incinerator of Nitrogenated Wastes, pp. (5B–23)–(5B–43) (no date).

*Primary Examiner*—Carl D. Price

*Attorney, Agent, or Firm*—Bill D. McCarthy; Randall K. McCarthy; Phillip L. Free, Jr.

[57] ABSTRACT

A process for minimizing the formation of nitrogen oxides in the disposal of industrial waste streams containing chemically bound nitrogen, the process comprising the steps of passing a combustion gas stream at about 1200° F. to about 2000° F. to a combustion chamber; mixing an industrial waste stream with a selected mixing ingredient to provide a waste stream mixture having a composition such that adiabatic combustion of the waste stream mixture would yield combustion products having a combustion temperature of about 1500° F. to about 2000° F.; injecting the waste stream mixture into the combustion chamber and contacting same with the combustion gas stream to combust the nitrogen containing compounds to form a composite combustion gas stream having a temperature of from about 1500° F. to about 2000° F. The composite combustion gas stream can be vented to the atmosphere after, preferably, passing same through heat recovery equipment. The selected mixing ingredient which is mixed with the industrial waste stream can be air, fuel or mixtures thereof.

24 Claims, 1 Drawing Sheet

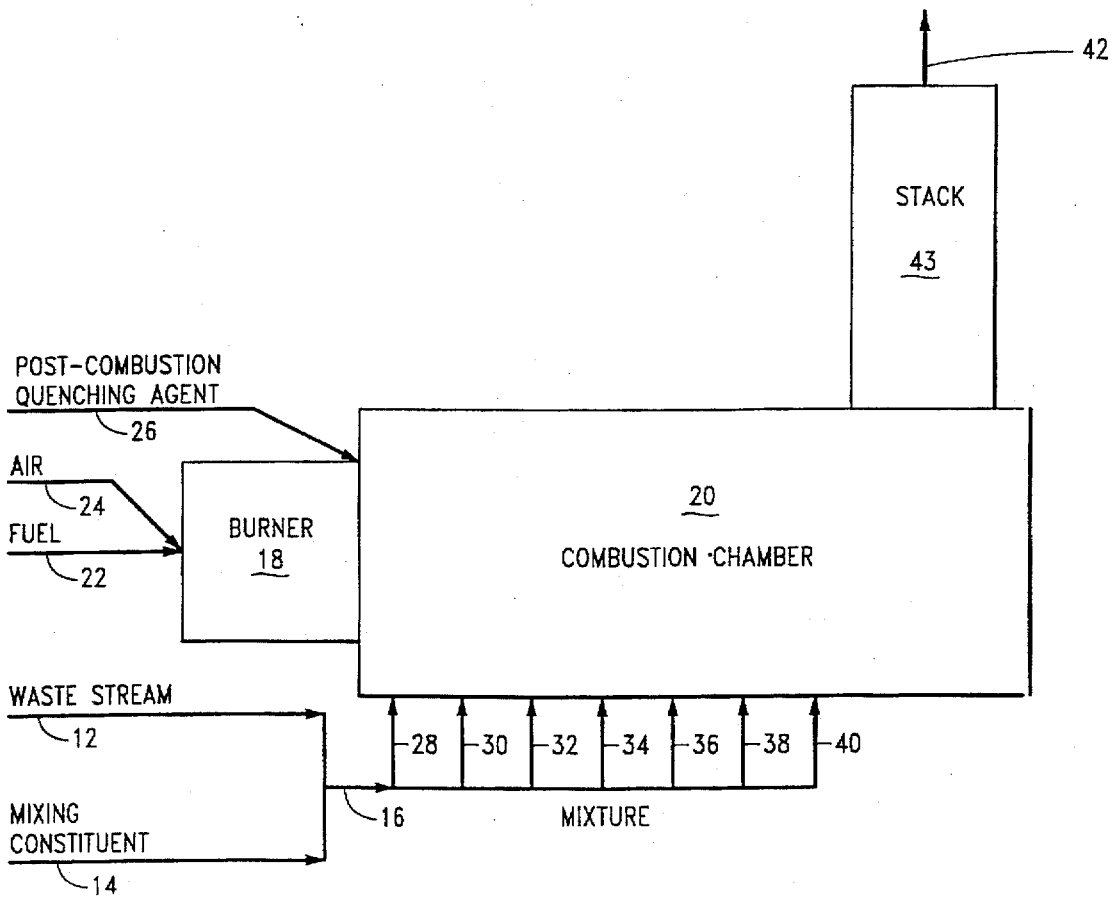
42
STACK
43
POST-COMBUSTION
QUENCHING AGENT
26
AIR
24
FUEL
22
BURNER
18
20
COMBUSTION CHAMBER
WASTE STREAM
12
MIXING
CONSTITUENT
14
16
28
30
32
34
36
38
40
MIXTURE

SINGLE-STAGE PROCESS FOR DISPOSAL OF CHEMICALLY BOUND NITROGEN IN INDUSTRIAL WASTE STREAMS

BACKGROUND OF INVENTION

1. Field of the Invention

The present invention relates to the disposal of industrial waste streams, and more particularly but not by way of limitation, to an improved process for disposing of industrial waste streams containing chemically bound nitrogen.

2. Discussion

Various industrial processes result in the production of large quantities of wastes which contain chemically bound nitrogen, that is, nitrogen which is bonded to an atom other than another nitrogen atom. For example, certain refinery processes produce large quantities of contaminated ammonia. Although some refiners are able to sell the ammonia as fertilizer or convert the ammonia to nitric acid, many others give the ammonia away or even pay for its disposal. Many of these refiners would like to control the disposal of the ammonia themselves, for instance by using the ammonia as fuel.

Presently, most hazardous wastes are disposed by incineration or landfilling. With regulations regarding landfills becoming more stringent and companies having cradle-to-grave responsibility for wastes landfilled, incineration or combustion has become an increasingly attractive alternative to landfill storage of wastes.

While incineration is an effective method of control for many pollutant species, the equipment must be properly designed and operated to minimize any undesirable by-products. The oxides of nitrogen ($NO_x$) are a few of the undesirable by-products of waste incineration. Nitric oxide (NO) and nitrogen dioxide ($NO_2$) are the primary nitrogen oxides formed, with others such as $N_2O$ produced in trace quantities. At the temperatures of most incineration applications, the majority of the nitrogen oxides ($NO_x$) are present as nitric oxide (NO). However, when gases containing nitric oxide (NO) enter the atmosphere, the nitric oxide is convened to nitrogen dioxide ($NO_2$) with time. Therefore, $NO_x$ emission calculations usually assume all of the $NO_x$ is in the $NO_2$ form because this is the form in the atmosphere.

Nitrogen dioxide ($NO_2$) is a toxic gas that the U.S. Environmental Protection Agency (EPA) has designated as a criteria pollutant because of its adverse effects on human health. Nitrogen oxides ($NO_x$) emitted from stationary combustion sources contribute to acid deposition and to the degradation of air quality by reacting with reactive hydrocarbons to form smog. For this reason, the amount of nitrogen oxides present in gases vented to the atmosphere is heavily regulated by various state and federal agencies and improved thermal destruction techniques are constantly being sought.

$NO_x$ is formed from one of three sources in a combustion/incineration process: thermal $NO_x$, prompt $NO_x$ and fuel bound $NO_x$. Most $NO_x$ emissions from combustion processes are generated from thermal fixation of nitrogen in the combustion air. The generally accepted mechanism of thermal $NO_x$ formation is described by the Zeldovich equilibrium reactions.

$$N_2+O\bullet \leftrightharpoons NO+N\bullet \quad (1)$$

$$N\bullet+O_2 \leftrightharpoons NO+O\bullet \quad (2)$$

As indicated by the above reactions, thermal $NO_x$ formation requires the dissociation of molecular nitrogen ($N_2$) and molecular oxygen ($O_2$). Due to the stability of these molecules, significant dissociation occurs only at high temperatures. In the high temperatures of the flame zone, significant amounts of $NO_x$ are produced. However, at temperatures of 1200°–2000° F. the reactions are limited by kinetics (the time required to reach equilibrium is much slower than the residence time in the incinerator) and produce very small amounts of $NO_x$.

Prompt $NO_x$ is a lesser known type of $NO_x$ formation. The formation of prompt $NO_x$ is proportional to the number of carbon atoms present in the fuel and has a weak temperature dependence and a short lifetime. Prompt $NO_x$ is only significant in fuel rich flames which inherently produce low $NO_x$ levels. Thus, prompt $NO_x$ is not usually a major contributor to overall $NO_x$ emissions.

Fuel bound $NO_x$ is generated from nitrogen compounds present in the waste or in the fuel itself. A significant portion of the fuel or waste nitrogen is converted to $NO_x$. The rate of conversion is much less than 1/1 however. Yet, as little as 1% conversion can produce $NO_x$ concentrations far above regulatory limits. The exact conversion rate is a complex function of stoichiometry, temperature, and the specific nitrogen compound being incinerated; and unfortunately, the detailed mechanisms and kinetics involved in fuel bound $NO_x$ formation are not completely understood. However, it is known that the following $NO_x$ generation reaction becomes significant above 2000° F.

$$4NH_3+5O_2 \leftrightharpoons 4NO+6H_2O \quad (3)$$

Thus, it is believed that fuel bound $NO_x$ production can be minimized at oxidation temperatures below 2000° F.

Every combustion process results in the production of some $NO_x$ and there have been considerable efforts in the art to find ways to remove or prevent the formation of nitrogen oxides ($NO_x$) in combustion gases so that such gases may be discharged to the atmosphere without harm to the environment. Methods to remove the nitrogen oxides in combustion gases after their formation are commonly referred to as "post combustion control techniques." The most established of such post combustion control techniques are selective non-catalytic reduction (SNCR) and selective catalytic reduction (SCR).

There are two commercially available SNCR systems. One is commonly referred to as Thermal DeNOx and was originally patented by Exxon, U.S. Pat. No. 3,900,554, issued to Lyon. The other SNCR process is commonly called NOxOUT. Both the Thermal DeNOx and NOxOUT processes involve injection of specific nitrogen bearing compounds, such as ammonia and urea, into the combustion products to reduce $NO_x$ produced during incineration. Both reduction reactions occur in a specific temperature range.

Various SCR techniques are known as well. In SCR techniques, as with Thermal DeNOx, ammonia is injected to reduce $NO_x$. However, in the SCR processes, the ammonia is injected upstream of a catalyst grid and the catalyst changes the optimum temperature range at which $NO_x$ reduction occurs.

Although post-combustion control techniques, such as SNCR and SCR systems, are often employed to reduce $NO_x$ emissions in waste combustion gases containing $NO_x$, "combustion control techniques" which prevent the formation of $NO_x$ during the combustion of the waste or fuel are more economical methods of meeting $NO_x$ emission requirements. Such combustion control techniques include burner and incinerator design considerations.

Most modern burner designs rely on the well established technique of recirculation of combustion products back into the flame envelope as a method of $NO_x$ reduction. Many low $NO_x$ burners use internal recirculation of the products of combustion to reduce $NO_x$ levels. Internal recirculation is typically accomplished through a bluff body, swirl vortex, baffle geometry, or toroidal ring. This provides optimum conditions in specific zones of the flame, and the more effectively these conditions are achieved, the more efficient the $NO_x$ reduction.

Other low $NO_x$ burners achieve similar results using external recirculation. This technique, called flue gas recirculation (FGR), recycles incinerator off-gas into the burner, often after cooling the recirculated flue gas in a heat recovery device. FGR suppresses $NO_x$ formation by lowering the oxygen content in the flame and, more significantly, by lowering the peak flame temperature as a result of the larger mass of gas heated.

Still other low $NO_x$ burners function by fuel staging in which a portion of the fuel is mixed with all of the combustion air in the primary combustion zone of the burner. The high level of excess air lowers the peak flame temperature, reducing $NO_x$ formation. Secondary fuel is injected through nozzles located at the perimeter of the burner causing the fuel gas to entrain incinerator gases and mix with the first stage combustion gases. This entrainment of combustion products, as in flue gas recirculation, serves to enhance $NO_x$ reduction from the burner.

The primary combustion control technique applied to fuels or wastes containing chemical bound nitrogen, however, is air staging. In this technique, the combustion air is split into two streams. The first portion of combustion air is mixed with the fuel or high BTU waste in selected substoichiometric quantities to produce a reducing environment. The second portion of combustion air is injected downstream to complete the combustion.

Although this technique can be employed as a burner design, when the waste stream contains a large quantity of nitrogen compounds the technique is typically applied to the overall incinerator design. The result is a two stage combustion system wherein the first stage operates under reducing conditions and the second stage operates under oxidizing conditions.

An example of such a two stage combustion system is disclosed in U.S. Pat. No. 4,519,993, issued to McGill et al. In the first stage, a waste stream containing chemically bound nitrogen is contacted with an effective amount of an oxygen-containing gas and a stoichiometric excess of a hydrocarbon fuel, based on the total amount of available oxygen, at a temperature between about 2000°–3000° F. to achieve reduction of the available oxygen and to provide a combustion effluent. The combustion effluent is contacted in the second stage with a non-flame propagating gaseous stream, to bring about oxidation of the combustion effluent at a temperature in a range of from about 1600° F. to about 1800° F., yielding an effluent substantially free of oxides of nitrogen. The oxidation effluent may be cooled in heat exchange equipment to recover energy, recycled to support the combustion and/or the oxidation of the combustibles, or vented to the atmosphere.

While there have been considerable efforts to find effective ways to remove, or prevent the formation of, nitrogen oxides in waste gases so that the waste gases can be discharged into the atmosphere without harm to the environment, new and improved processes are constantly being sought which will eliminate the deficiencies of the prior art processes, and which are safe to operate, economical to employ and meet the increasingly stringent regulatory requirements placed on vented waste gases by federal and state agencies.

SUMMARY OF THE INVENTION

The present invention provides a process for minimizing the formation of oxides of nitrogen in the disposal of an industrial waste stream containing chemically bound nitrogen. Broadly, the process comprises the steps of: mixing an industrial waste stream with a mixing constituent to provide a waste stream mixture; passing a combustion gas stream having a temperature greater than the ignition temperature of the waste stream mixture into a combustion chamber; injecting at least a portion of the waste stream mixture into the combustion chamber to mix with the combustion gas stream, wherein the waste stream mixture is injected at an effective rate and temperature such that the instantaneous gas phase temperature of the mixed waste stream mixture and combustion gas stream is no less than the ignition temperature of the waste stream mixture; combusting the waste stream mixture to create combustion products which mix with the combustion gas stream to form a composite combustion gas stream, wherein the composition and temperature of the injected waste stream mixture is such that the temperature of the composite combustion gas stream is no greater than about 2000° F.; and venting the composite combustion gas stream to the atmosphere. The mixing constituent is air, fuel or a combination thereof, depending upon the concentration of combustibles in the industrial waste stream. The post-combustion quenching agent is selected from the group consisting of air, water, steam or flue gas.

An object of the present invention is to provide a process for converting waste streams containing chemically bound nitrogen into streams which can be vented safely into the atmosphere without harm to the environment.

Another object of the present invention, while achieving the above stated object, is to provide a process for minimizing the formation of oxides of nitrogen in the disposal of an industrial waste stream containing chemically bound nitrogen.

Still another object of the present invention, while achieving the above stated objects, is to provide a more economical process for the thermal destruction of industrial waste streams having chemically bound nitrogen which yield emissions in compliance with state and federal regulations.

Other objects, advantages and features of the present invention will become apparent from a reading of the following description taken in conjunction with the accompanying drawing and appended claims.

BRIEF DESCRIPTION OF THE DRAWING

The drawing which accompanies the present disclosure and descriptions thereof is merely illustrative of the invention, the precise scope of which is as defined in the appended claims. Further, auxiliary equipment, such as valves, flowmeters and the like, has been omitted from the drawing for the sake of clarity, because a description of such equipment is not required for an understanding of the invention.

The figure is a schematic flow diagram depicting the process of the present invention.

DESCRIPTION

The present invention relates to an improved process for disposing of industrial waste streams containing chemically bound nitrogen. The process includes the combustion of industrial waste streams containing chemically bound nitrogen under conditions that yield low concentrations of nitrogen oxides ($NO_x$) so that the combustion products may be vented to the atmosphere without harm to the environment. Gaseous streams containing chemically bound nitrogen can be treated using the process of the present invention, as well as liquids which can be vaporized. Illustrative of such streams are: ammonia and ammonia waste streams, hydrazine and hydrazine waste streams, amines, and other chemical products, byproducts and waste.

The composition of the above mentioned industrial waste streams will vary substantially. However, all these streams contain chemically bound nitrogen which, when subjected to a typical combustion process, produces nitrogen oxides ($NO_x$). Such waste streams generally contain components which make their direct atmospheric discharge environmentally unacceptable.

It should be understood that the process of the present invention is designed to minimize the formation of nitrogen oxides ($NO_x$) in the thermal destruction of industrial waste streams, rather than to remove or destroy nitrogen oxides already present in such waste streams or to treat compounds that already have nitrogen bonded to oxygen, such as compounds having nitro groups. Thus, for the purpose of the present disclosure "chemically bound nitrogen" will be understood to include compounds with nitrogen bonded to hydrogen or carbon, singly or in combination, as for example, ammonia, hydrazine, amines and the like, but not compounds with nitrogen bonded to oxygen.

Pursuant to the present invention, as depicted schematically in the Figure, an industrial waste stream 12 containing chemically bound nitrogen is blended or mixed with a mixing constituent 14 as necessary to provide a waste stream mixture 16 desirably having a composition such that adiabatic combustion of the waste stream mixture 16 would yield combustion products having a temperature of from about 1500° F. to about 2000° F., and preferably about 1800° F. Blended in this manner, the waste stream mixture 16 will be below the lower flammability limit of the waste stream, that is below the minimum concentration of oxidizable gas in air or oxygen which would propagate a flame upon contact with an ignition source. The temperature of the waste stream mixture 16 can vary widely, but will, of course, be below the ignition temperature for the waste stream mixture 16.

The mixing constituent 14 can be fuel, air or a combination thereof, depending upon whether the industrial waste stream 12 is highly concentrated with combustible compounds, or a gas stream contaminated with a relatively dilute concentration of combustible compounds, or perhaps even a gas stream contaminated with a relatively dilute concentration of combustible compounds and having insufficient oxygen for proper combustion. For example, if the industrial waste stream 12 has a concentration and temperature of combustible compounds such that adiabatic combustion of the industrial waste stream 12, when mixed with the amount of air required for proper combustion, would yield combustion products having a temperature of greater than 2000° F. (i.e., a concentrated waste stream), then the mixing constituent 14 will be air. The industrial waste stream 12 is mixed with the air in such a ratio as to provide a waste stream mixture 16 such that adiabatic combustion of the waste stream mixture 16 would yield combustion products having a temperature of from about 1500° F. to about 2000° F., and preferably about 1800° F.

On the other hand, if the industrial waste stream 12 has a low concentration of combustible compounds and a temperature such that adiabatic combustion of the industrial waste stream 12 would yield combustion products having a temperature of less than 2000° F. (i.e., a dilute waste stream), then the mixing constituent 14 will be fuel. The fuel can be any suitable hydrocarbon or other reducing agent which is preferably substantially completely oxidized to carbon dioxide and water upon combustion. Desirably, the fuel will have a low molecular weight, and comprise, for example, methane, ethane, and mixtures thereof, such as natural gas. The industrial waste stream 12 is mixed with the fuel in such a ratio as to provide a waste stream mixture 16 such that adiabatic combustion of the waste stream mixture 16 would yield combustion products having a temperature of from about 1500° F. to about 2000° F.

Similarly, if the industrial waste stream 12 has a low concentration of combustible compounds and also a low concentration of oxygen, the industrial waste stream 12 is mixed with fuel and air in such a ratio as to provide a waste stream mixture 16 such that adiabatic combustion of the waste stream mixture 16 would yield combustion products having a temperature of from about 1500° F. to about 2000° F.

A combustion gas stream is generated to provide an ignition source and to establish an operating temperature above the minimum ignition temperature. Generally, the operating temperature will be no greater than about 2000° F., and preferably about 1800° F. Temperature rather than composition is the governing characteristic of the combustion gas stream, and persons skilled in the art will recognize numerous ways of producing a combustion gas stream in the desired temperature range, all of which are included in the scope of the present invention.

In one embodiment, a burner 18 supplies the combustor gas stream which is passed to a combustion chamber 20, as depicted schematically in the figure. A fuel stream 22 and a combustion air stream 24 are supplied to the burner 18 via conduit and combusted to produce a stream of hot combustion products.

The fuel stream 22 can be any suitable hydrocarbon which is preferably substantially oxidized to carbon dioxide and water upon combustion. Desirably, the fuel stream 22 will have a low molecular weight, and comprise, for example, methane, ethane, or mixtures thereof, such as natural gas. The amount and rate of injection of fuel into the burner 18 can vary widely and will depend to a large extent upon the amount of waste injected in subsequent process steps.

As necessary, a post-combustion quenching agent stream 26, such as air, water, steam or flue gas, is provided to the hot combustion products via a conduit to mix with and cool the hot combustion products, thereby forming the combustion gas stream. Various post-combustion quenching agents are know to those of skill in the art and all are encompassed within the spirit and scope of the present invention. The amount and rate of the post-combustion quenching agent stream 26 is adjusted so that the resultant combustion gas stream has a temperature above the ignition temperature of the waste stream mixture 16 (e.g., from about 1200° F. to about 2000° F., and preferably about 1800° F.) as the combustion gas stream is vented into the combustion chamber 20.

At least a first portion stream 28 of the waste stream mixture 16 is injected into the combustion chamber 20 and mixed with the combustion gas stream. The first portion stream 28 of the waste stream mixture 16 is injected at a rate and temperature such that the instantaneous gas phase temperature of the mixed first portion stream 28 and combustion gas stream, that is, the temperature prior to combustion, is no less than the ignition temperature of the waste stream mixture 16, preferably no less than 1200° F. The waste compounds, including the chemically bound nitrogen, are thereby combusted, producing more combustion products. The combustion products mix with the combustion gas stream to form a composite combustion gas stream. The temperature and the composition of the injected first stream portion 28 of the waste stream mixture 16 is such that the temperature of the composite combustion gas stream is no greater than 2000° F.

Because the waste stream mixture 16 will normally be large in comparison to the combustion gas stream, it will not usually be possible to charge all of the waste stream mixture 16 in the combustion chamber 20 at once. Injection of such a large quantity of waste stream mixture 16 can cool the combustion chamber 20 sufficiently to prevent ignition. To assure combustion of the waste stream mixture 16, the waste stream mixture 16 is split into smaller waste stream mixture portions 28, 30, 32, 34, 36, 38, 40. These waste stream mixture portions 28, 30, 32, 34, 36, 38, 40 can be increasingly larger because with each injection the size of the composite combustion gas stream grows, thereby creating an increasingly larger ignition source. The waste stream mixture injectors and the combustion chamber 20 must be designed in such a manner as to provide for good mixing between the waste stream mixture portions 28, 30, 32, 34, 36, 38, 40 and the combustion gas stream. Although seven waste stream mixture portions 28, 30, 32, 34, 36, 38, 40 are shown in the figure, there is no theoretical limit to the number of mixture portions for individual injection.

An overall resultant composite combustion gas stream 42 is discharged from the combustion chamber 20 via a vent stack 43 for venting to the atmosphere. The composite combustion gas stream 42 vented to the atmosphere via the stack 43 is composed of nitrogen, carbon dioxide, water vapor and oxygen, the composite combustion gas stream 42 being substantially free of smoke, combustibles and nitrogen oxides ($NO_x$) and environmentally safe.

Alternatively, the resultant composite combustion gas stream can be discharged from the combustion chamber 20 to a heat exchanger (not shown), such as a waste heat boiler, a superheater, an economizer or combination thereof, so that the oxidation products are in heat exchange relationship with a coolant in the heat exchanger for the recovery of useful energy, a typical coolant being steam. The cooled composite combustion gas stream exiting the heat exchanger may be routed to a vent stack for venting to the atmosphere.

To more fully describe the process of the present invention for minimizing the formation of nitrogen oxides ($NO_x$) in the thermal destruction, the following examples are given. However, it is to be understood that the examples given are for illustrative purposes and are not to be construed as limiting the present invention defined in the appended claims. For the sake of clarity, reference will be made to the process embodiment illustrated in the Figure.

EXAMPLE I

An industrial waste stream 12 of 4,032 lbs./hr. of ammonia, with a heat release of 32 MM Btu/hr., is disposed in accordance with the present invention. To create a stream of hot combustion products, 70 lbs./hr. of methane fuel 22 are combusted in a regular burner with 1,700 lbs./hr. of combustion air 24. The hot combustion products are cooled by addition of 1,200 lbs./hr. of post-combustion quench air 26 to produce a combustion gas stream of 2,970 lbs./hr. having a temperature of about 1800° F.

The ammonia waste stream 12 is pre-mixed with air 14 in such a ratio that adiabatic combustion of the resultant ammonia/air mixture 16 would yield sufficient heat of combustion to raise the temperature of the combustion products to about 1800° F. The correct ratio of ammonia to air yields an ammonia/air mixture 16 that contains 6.4 wt. % ammonia.

The ammonia/air mixture 16 is split into small, but increasingly larger ammonia/air mixture portions 28, 30, 32, 34, 36, 38, 40. The first portion stream 28 of the ammonia/air mixture 16 is injected at a rate of 1,653 lbs./hr. into the combustion chamber 20, wherein the first portion stream 28 contacts the 2,970 lbs./hr. of the 1800° F. combustion gas stream. The ammonia in the first portion stream 28 ignites, releasing sufficient heat of combustion to heat the resultant composite combustion gas stream to 1800° F.

Because the composite combustion gas stream resulting from injection of the first portion stream 28 is larger than the original combustion gas stream, the size of the second portion stream 30 can be increased to 2,578 lbs./hr. For each of the subsequent ammonia/air mixture portions 32, 34, 36, 38, 40, the quantity of the ammonia/air mixture increases, as tabulated below in Table I, which reflects the compositional make-up and quantity (lbs/hr) for each stream.

TABLE I

| | | | | | Ammonia Waste Stream Material Balance | | | | | | | | | |
|---|---|---|---|---|---|---|---|---|---|---|---|---|---|---|
| lb/hr | 12 | 14 | 16 | 22 | 24 | 26 | 28 | 30 | 32 | 34 | 36 | 38 | 40 | 42 |
| Oxygen | | 13,409 | 13,409 | | 395 | 278 | 350 | 545 | 851 | 1,327 | 2,070 | 3,229 | 5,038 | 8,119 |
| Nitrogen | | 45,958 | 45,958 | | 1,305 | 922 | 1,198 | 1,869 | 2,915 | 4,548 | 7,095 | 11,068 | 17,266 | 51,502 |
| Ammonia | 4,032 | | 4,032 | | | | 105 | 164 | 256 | 399 | 622 | 971 | 1,515 | |
| Water | | | | | | | | | | | | | | 6,555 |
| Carbon Dioxide | | | | | | | | | | | | | | 193 |
| Methane | | | | 70 | | | | | | | | | | |
| Total | 4,032 | 59,367 | 63,399 | 70 | 1,700 | 1,200 | 1,653 | 2,578 | 4,022 | 6,274 | 9,787 | 15,268 | 23,818 | 66,369 |

Total In (12, 14, 22, 24, 26) = 66,369
Total Out (42) = 66,369

The above process example results in a composite combustion gas stream 42 of 66,369 lbs./hr. being vented safely to the atmosphere through the stack 43 without harm to the environment.

EXAMPLE II

An air stream contaminated with 1 vol. % ammonia is disposed in accordance with the present invention. To create a stream of hot combustion products, 70 lbs./hr. of methane fuel 22 are combusted in a regular burner with 1,700 lbs./hr. of combustion air 24. The hot combustion products are cooled by addition of 1,200 lbs./hr. of post-combustion quench air 26 to produce a combustion gas stream of 2,970 lbs./hr. having a temperature of 1800° F.

The ammonia waste stream 12, composed of 1 vol. % ammonia, at a rate of 42,079 lbs./hr. is pre-mixed with 872 lbs./hr. of methane fuel 14, resulting in an ammonia/methane/air mixture 16 of 42,951 lbs./hr. The methane fuel 14 is added to obtain a concentration of 2.0 wt. %, which is sufficient to raise the temperature of the combustion products to about 1800° F. during adiabatic combustion.

The ammonia/methane/air mixture 16 is split into small, but increasing larger ammonia/methane/air mixture portions 28, 30, 32, 34, 36, 38 (Note that stream 40 is not needed.). The first portion stream 28 of the ammonia/methane/air mixture 16 is injected at a rate of 1,711 lbs./hr. into the combustion chamber 20, wherein the first portion stream 28 contacts the 2,970 lbs./hr. of the 1800° F. combustion gas stream. The ammonia and methane in the first portion stream 28 ignites, releasing sufficient heat of combustion to heat the resultant composite combustion gas stream to about 1800° F.

Because the composite combustion gas stream resulting from injection of the first portion stream 28 is larger than the original combustion gas stream, the size of the second portion stream 30 can be increased to 2,704 lbs./hr. For each of the subsequent ammonia/air mixture portions 32, 34, 36, 38, the quantity of the ammonia/air mixture increases, as tabulated below in Table II.

TABLE II

| | 1 Vol. % Ammonia In Air Waste Stream Material Balance | | | | | | | | | | | | |
|---|---|---|---|---|---|---|---|---|---|---|---|---|---|
| lb/hr | 12 | 14 | 16 | 22 | 24 | 26 | 28 | 30 | 32 | 34 | 36 | 38 | 42 |
| Oxygen | 9,411 | | 9,411 | | 395 | 278 | 375 | 592 | 936 | 1,479 | 2,337 | 3,692 | 5,965 |
| Nitrogen | 32,418 | | 32,418 | | 1,305 | 922 | 1,292 | 2,041 | 3,224 | 5,094 | 8,049 | 12,718 | 34,850 |
| Ammonia | 249 | | 249 | | | | 10 | 16 | 25 | 39 | 62 | 98 | |
| Water | | | | | | | | | | | | | 2,515 |
| Carbon Dioxide | | | | | | | | | | | | | 2,591 |
| Methane | | 872 | 872 | 70 | | | 35 | 55 | 87 | 137 | 217 | 342 | |
| Total | 42,079 | 872 | 42,951 | 70 | 1,700 | 1,200 | 1,711 | 2,704 | 4,272 | 6,750 | 10,666 | 16,851 | 45,921 |

Total In (12, 14, 22, 24, 26) = 45,921
Total Out (42) = 45,921

The above process example results in a composite combustion gas stream 42 of 45,921 lbs./hr. being vented safely to the atmosphere through the stack 43 without harm to the environment.

It is clear that the present invention is well adapted to carry out the objects and to attain the ends and advantages mentioned as well as those inherent therein. While presently preferred embodiments have been described for purposes of this disclosure, numerous changes may be made which will readily suggest themselves to those skilled in the art and which are encompassed within the spirit of the invention disclosed and as defined in the appended claims.

What is claimed is:

1. A process for minimizing the formation of oxides of nitrogen in the disposal of an industrial waste stream containing chemically bound nitrogen, the process comprising:

mixing the industrial waste stream with a mixing constituent to provide a waste stream mixture;

passing a combustion gas stream having a temperature greater than the ignition temperature of the waste stream mixture into a combustion chamber;

injecting at least a portion of the waste stream mixture into the combustion chamber to mix with the combustion gas stream, wherein the waste stream mixture is injected at an effective rate and temperature such that the instantaneous gas phase temperature of the mixed waste stream mixture and combustion gas stream is no less than the ignition temperature of the waste stream mixture;

combusting the waste stream mixture to create combustion products which mix with the combustion gas stream to form a composite combustion gas stream, wherein the composition and temperature of the injected waste stream mixture is such that the temperature of the composite combustion gas stream is no greater than about 2000° F.; and venting the composite combustion gas stream.

2. The process of claim 1 wherein the combustion gas stream is formed by a process comprising the steps of:

combusting a fuel in air in a burner to provide a stream of hot combustion products; and cooling the stream of hot combustion products to a temperature of from about the ignition temperature of the waste stream mixture to about 2000° F. by addition of a post-combustion quenching agent to form the combustion gas stream.

3. The process of claim 2 wherein the post-combustion quenching agent is selected from the group consisting of air, water, steam and flue gas.

4. The process of claim 1 wherein the temperature of the composite combustion gas stream is from about 1500° F. to about 2000° F.

5. The process of claim 4 wherein the combustion gas stream is about 1800° F.

6. The process of claim 1 wherein the industrial waste stream is mixed with a mixing constituent to provide a waste stream mixture having a composition and temperature so that adiabatic combustion of the waste stream mixture would yield combustion products having a temperature of from about 1500° F. to about 2000° F.

7. The process of claim 6 wherein the industrial waste stream is mixed with a mixing constituent to provide a waste stream mixture having a composition so that adiabatic combustion of the waste stream mixture would yield combustion products having a temperature of about 1800° F.

8. The process of claim 1 wherein the mixing constituent comprises air.

9. The process of claim 1 wherein the mixing constituent comprises fuel.

10. The process of claim 1 wherein the mixing constituent comprises a mixture of air and fuel.

11. A process for minimizing the formation of oxides of nitrogen in the disposal of an industrial waste stream containing chemically bound nitrogen, the process comprising:

passing a combustion gas stream of no greater than about 2000° F. into a combustion chamber;

mixing the industrial waste stream with a selected mixing constituent as necessary to provide a waste stream mixture having a composition and temperature so that adiabatic combustion of the waste stream mixture would yield combustion products having a temperature of no greater than about 2000° F.;

injecting at least a portion of the waste stream mixture into the combustion chamber to contact the combustion gas stream to form a composite combustion gas stream, the waste stream mixture injected at an effective rate and temperature so that the instantaneous gas phase temperature of the mixed waste stream mixture and combustion gas stream is no less than about 1200° F. and so that the temperature of the composite combustion gas stream is no greater than about 2000° F.; and venting the composite combustion gas stream from the combustion chamber.

12. The process of claim 11 wherein the combustion gas stream is formed by the steps of:

combusting a fuel in air in a burner to provide a stream of hot combustion products; and cooling the stream of hot combustion products to a temperature of no greater than about 2000° F. by addition of a post-combustion quenching agent to form the combustion gas stream.

13. The process of claim 12 wherein the post-combustion quenching agent is selected from the group consisting of air, water, steam, flue gas and mixtures thereof.

14. The process of claim 13 wherein the combustion gas stream is about 1800° F.

15. The process of claim 14 wherein the industrial waste stream is mixed with a mixing constituent as necessary to provide a waste stream mixture having a composition and temperature such that adiabatic combustion of the waste stream mixture would yield combustion products having a temperature of about 1800° F.

16. The process of claim 11 wherein the mixing constituent comprises air.

17. The process of claim 11 wherein the mixing constituent comprises fuel.

18. The process of claim 11 wherein the mixing constituent comprises a mixture of fuel and air.

19. A process for minimizing the formation of oxides of nitrogen in the disposal of an industrial waste stream containing chemically bound nitrogen, the process comprising:

passing a combustion gas stream of no greater than about 2000° F. into a combustion chamber;

mixing the industrial waste stream with a selected mixing constituent as necessary to provide a waste stream mixture having a composition such that adiabatic combustion of the waste stream mixture would yield combustion products having a temperature of from about 1500° F. to about 2000° F.;

splitting the waste stream mixture into a plurality of waste stream mixture portions;

injecting a plurality of the waste stream mixture portions into the combustion chamber at a plurality of points along the combustion chamber to mix the plurality of waste stream mixture portions with the combustion gas stream so that the instantaneous gas phase temperature of the mixed waste stream mixture and combustion gas stream is no less than about 1200° F.;

combusting the plurality of waste stream mixture portions, to form a composite combustion gas stream, the concentration and temperature of the injected waste stream mixture portions determined such that the temperature of the composite combustion gas stream is no greater than about 2000° F.; and venting the composite combustion gas stream from the combustion chamber.

20. The process of claim 19 wherein the combustion gas stream is formed by the steps of:

combusting a fuel in air in a burner to provide a stream of hot combustion products; and cooling the stream of hot combustion products to a temperature of no greater than about 2000° F. by addition of a post-combustion quenching agent.

21. The process of claim 20 wherein the post-combustion quenching agent is selected from the group consisting of air, water, steam, flue gas and mixtures thereof.

22. The process of claim 19 wherein the mixing constituent comprises air.

23. The process of claim 19 wherein the mixing constituent comprises fuel.

24. The process of claim 19 wherein the mixing constituent comprises a mixture of fuel and air.

* * * * *